US005116268A

United States Patent [19]

Eninger et al.

[11] Patent Number: 5,116,268

[45] Date of Patent: May 26, 1992

[54] BUOY FLOTATION GIMBAL

[75] Inventors: James E. Eninger, Torrance; James M. Zamel, Hermosa; Richard L. Prossen, San Pedro, all of Calif.

[73] Assignee: The United States of America as represented by the Secretary of the Navy, Washington, D.C.

[21] Appl. No.: 712,784

[22] Filed: Jun. 10, 1991

[51] Int. Cl.[5] ..... B63B 22/02

[52] U.S. Cl. ..... 441/3

[58] Field of Search ..... 441/1, 3, 4, 5, 6, 111, 441/21, 23-27; 114/264, 265; 175/18

[56] References Cited

U.S. PATENT DOCUMENTS

| | | | |
|---|---|---|---|
| 3,425,069 | 2/1969 | Christians | 441/3 |
| 4,231,312 | 11/1980 | Persons | 441/6 |
| 4,651,834 | 3/1987 | Eninger et al. | 175/18 |

*Primary Examiner*—Jesus D. Sotelo

*Attorney, Agent, or Firm*—Michael J. McGowan; Prithvi C. Lall; Michael F. Oglo

[57] ABSTRACT

A flotation gimbal for a buoy which comprises a flotation bladder connected to the buoy by a pair of looped risers. The risers are anchored to the buoy by a guide in which the risers are allowed to freely move to maintain even tension on the risers as the position of the flotation bladder is tilted.

12 Claims, 3 Drawing Sheets

BUOY FLOTATION GIMBAL

STATEMENT OF GOVERNMENT INTEREST

The invention described herein may be manufactured and used by or for the government of the United States of America for governmental purposes without the payment of royalties thereon or therefore.

BACKGROUND OF THE INVENTION (1) Field of the Invention

The present invention relates to a flotation device for a buoy and more particularly to a flotation device which acts as a gimbal for maintaining the buoy in a substantially vertical position as the position of the flotation device is varied.

(2) Description of Prior Art

During the typical operation of an Arctic buoy, a flotation bladder is deployed to anchor the buoy under the polar ice cap. An ice penetrator, which is received in the buoy housing, pushes upward through the ice to the surface to allow an antenna to be deployed above the ice. The flotation bladder, which typically takes the shape of a toroid, is attached to the buoy housing by an annular web anchored within the buoy housing. The submerged surface of the polar ice cap can be inclined significantly. This incline is transferred to the buoy housing by uneven tension in the annular web due to the angled position of the bladder. As a result, the penetrator is forced through the ice at an angle. Due to the fixed-length of the web and the inclined bottom surface of the ice, the resulting penetration in non-vertical. This results in the penetration path being lengthened, which reduces the vertical ice thickness that can be penetrated. In addition, the time to penetrate a given ice thickness is increased. Furthermore, the antenna which is finally deployed above the ice will be tilted.

SUMMARY OF THE INVENTION

Accordingly, it is a general purpose and object of the present invention to provide a means for maintaining a buoy in a substantially vertical position under conditions in which the buoy flotation bladder is not level.

It is a further object of the invention that the penetration path of the ice penetrator be maintained as short as possible to thereby increase the vertical ice thickness which can be penetrated.

Another object of the invention is that the time to penetrate the given ice thickness is minimized.

Still another object is that an antenna or other device deployed above the ice is not tilted and thereby the function of that device is not adversely affected.

These objects are accomplished by the present invention by providing a device for maintaining a buoy in a substantially vertical position comprising a flotation means disposed above the buoy, a first riser or flotation line attached to the flotation means at a first and second point and a second riser or flotation line also attached to the flotation means at a third and fourth point, and means for guiding the first and second risers disposed on the buoy wherein the guiding means allows the first and second risers to move freely within the guide means to maintain even tension along the risers as the position of the flotation means is varied.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
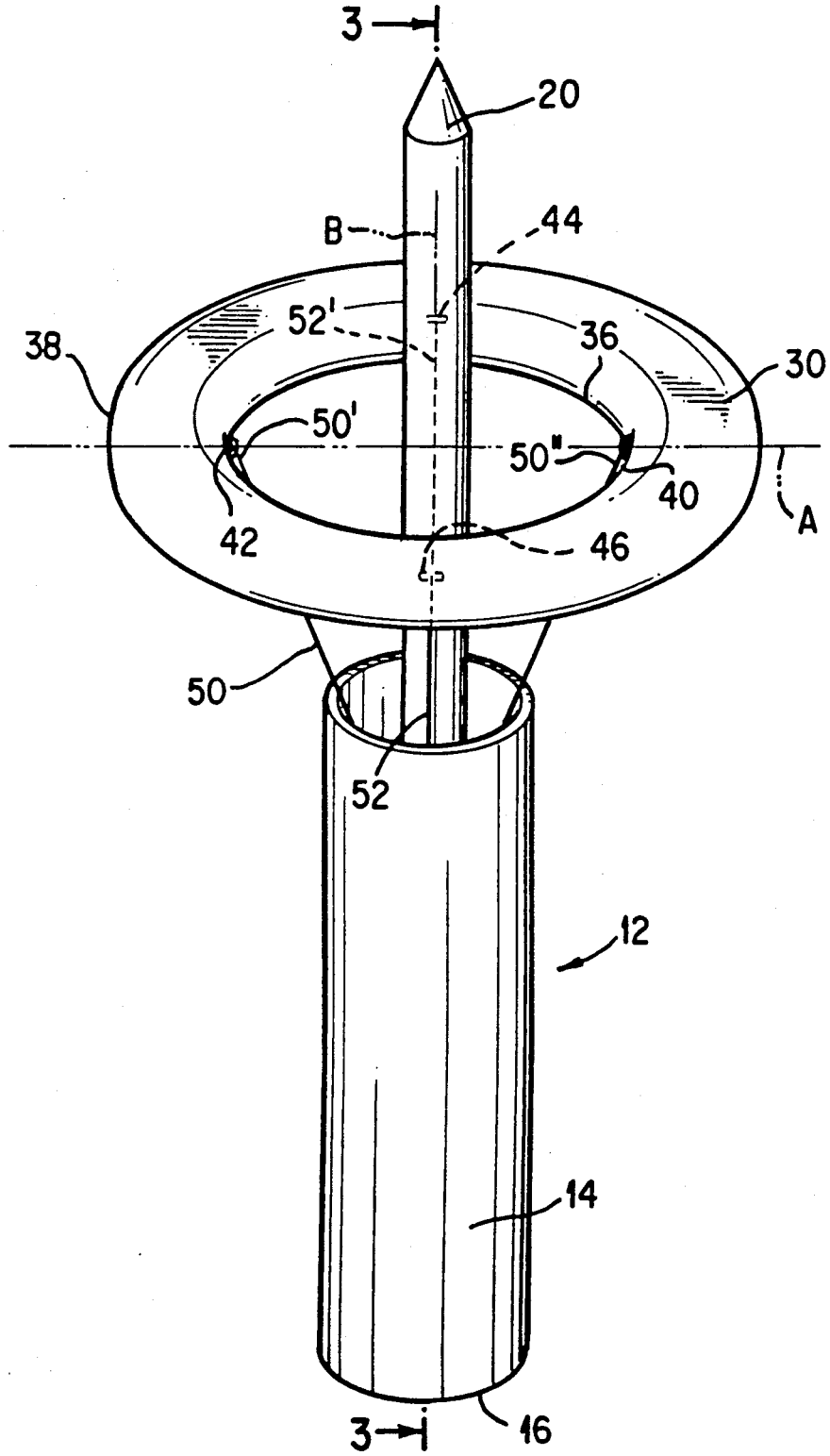
FIG. 1 is a perspective view of the flotation device of the present invention.
Figure 2:
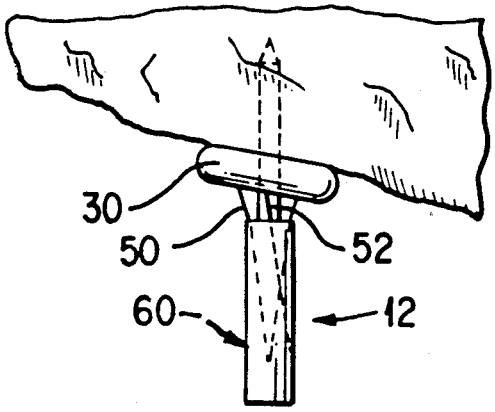
FIG. 2 shows the flotation device of the present invention deployed beneath the polar ice cap.

Referring now to FIGS. 1 and 2, the flotation device of the present invention for maintaining a substantially vertical position of a buoy 12 is shown. The flotation device comprises three main components: a flotation bladder 30, risers 50 and 52, and a guide anchor 60, each of which will be described in more detail below. As best seen in FIG. 1, buoy 12 includes a housing 14, which is generally cylindrical, and a base 16 disposed on the bottom thereof which is substantially flat. Received within the hollow cylinder of buoy 12 is an extendable-mast housing 18, which is also generally cylindrical (FIGS. 3-5) having a central axis that is common to the central axis of housing 14. Disposed within the buoy housing and extending through the central opening of the flotation bladder is an ice penetrator 20 for penetrating the ice. Ice penetrator 20, which is attached to the top of the extendable mast, also has a central axis common with the central axis of housing 14. Ice penetrator 20 is described in detail in U.S. Pat. No. 4,651,834, the disclosure of which is incorporated in its entirety herein by reference thereto. For illustrative purposes, ice penetrator and mast 20 is shown extending from mast housing 18. In actual use, the ice penetrator may be separate from mast housing 18. Other equipment may also be housed in buoy housing 14 including electronic equipment for deploying the flotation bladder and ice penetrator. While buoy 12 and mast housing 18 are shown in the FIGS. as cylindrical, it should be appreciated that they are not limited to such shapes as other shapes may be aptly suited given the end use of the buoy. Similarly, although an Arctic buoy is shown and described, the principles of the invention can be used to maintain the position of many types of buoys.

Turning now to flotation bladder 30, it is shown in the drawings as being toroid-shaped. In its preferred embodiment, flotation bladder 30 is formed of two polyurethane sheets 32 and 34, which are heat sealed along the inner perimeter 36 and outer perimeter 38 of flotation bladder 30. Sheets 32 and 34 are preferably 0.005-in. thick. Inner and outer perimeters 36, 38 are circular in shape and follow the profile of the toroid-shaped flotation bladder. Polyurethane sheets are preferred since the bladder may be inflated by any suitable pump and valve means (not shown) diposed within the buoy housing. However, rather than being inflated, the buoy may be formed of suitable solid material which is capable of floating such as styrofoam and cork. In this particular embodiment, an inflatable bladder is preferred since it can be easily stored in the buoy housing in a deflated condition until deployed to the position shown in FIG. 1.

Figure 6:
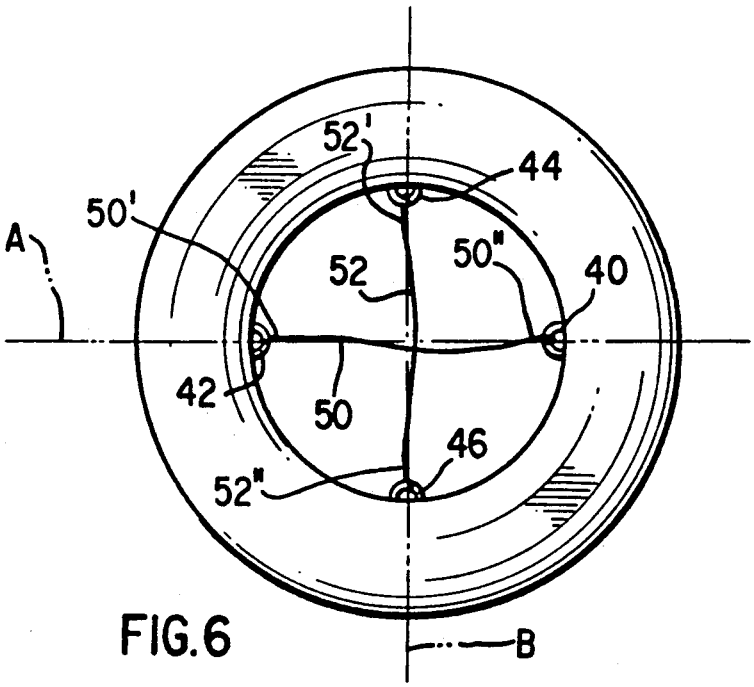
FIG. 6 is a top view of the flotation bladder and risers only.

Disposed along inner perimeter 36 of flotation bladder 3 are four distinct points to which risers 50 and 52 are attached as described below. First point 40 and second point 42 are disposed opposite each other such that a first imaginary line A can be drawn between them. Third point 44 and fourth point 46 are also disposed opposite each other such that imaginary line B can be drawn between them. As best seen in FIG. 6, first imaginary line A is substantially perpendicular to second imaginary line B.

With continuing reference to FIG. 6, first, second, third and fourth points 40, 42, 44 and 46 are shown as semi-circular tabs with a central aperture. The central apertures may be reinforced to resist the added tensile loading of an open-water deployment. Any other configuration suitable for attachment of risers 50 and 52 described below may be appropriate. One means of attaching the risers 50 and 52 to the tabs would be to simply knot the end of the line with itself after inserting it in through the tabs.

Risers 50 and 52 are configured as two crossed loops that hang from the inner perimeter 36 of the bladder 30. The lines are preferably formed of KEVLAR or other aramid fiber suitable for high-tension use. A small-diameter 100 lb. KEVLAR line has been found to minimize the chance of tangling during deployment, with two 175 lb. minimum break strength lines preferred. First riser 50 includes a first end 50' and a second end 50''. Second riser 52 also includes a first end 52' and a second end 52''. In the embodiment shown in the FIGS. and for the purposes described herein, the length of first and second risers is equal, such length being critical to the stability of the buoy and determined by a consideration of moments on the buoy deployed below the ice, which is represented by the equation:

$$S = W(D_{cg} - D_o) - B(D_{cg} - D_o) - F(D - D_o)$$

where

- S = A stability parameter (must be positive for stability)
- W = Weight less end cap and flotation bladder (8.9 lb)
- B = Buoyancy less end cap and flotation bladder (2.8 lb)
- F = Force of the extendable mast (7.0 lb)
- D = Depth of top of buoy housing below the ice (8 in.)
- $D_o$ = Distance from top of buoy housing to geometric intersection of risers (2 in.)
- $D_{cg}$ = Distance from the top of buoy housing to the center of gravity of the buoy (24 in.)
- $D_{cp}$ = Distance from top of buoy housing to center of buoyance of the buoy (34 in.)

for the type of buoy shown. The values of these parameters which have operated successfully are shown in parenthesis above.

Figure 3:
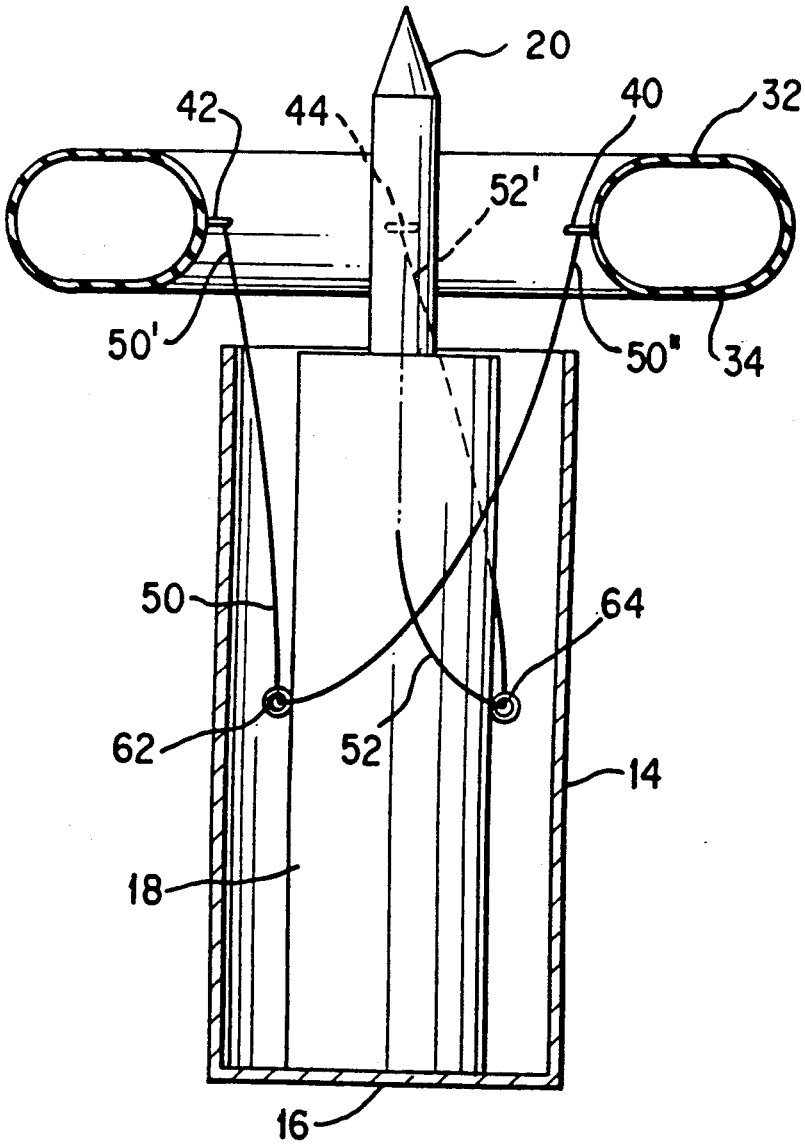
FIG. 3 is a cross-sectional view taken along line 3—3 in FIG. 1.
Figure 4:
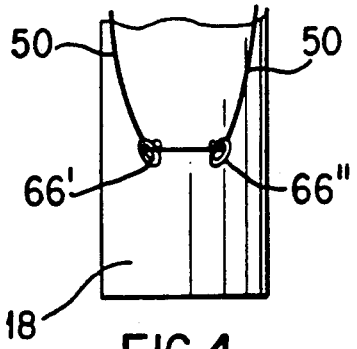
FIG. 4 is a cutaway view showing a modified embodiment of the present invention.
Figure 5:
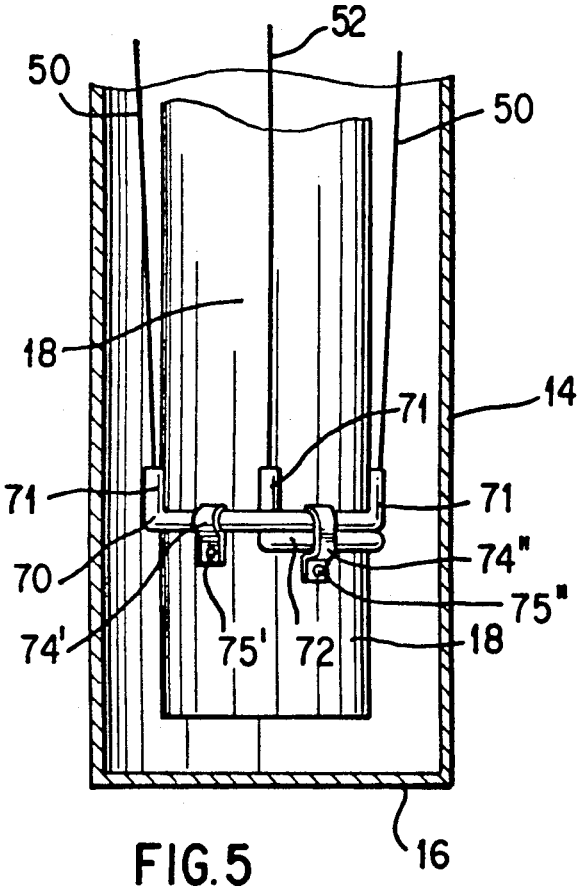
FIG. 5 is a cutaway view showing a further modified embodiment of the present invention.

An important feature of the present invention is the guide anchor shown generally at 60 (FIG. 2) which is disposed within buoy 12. Guide anchor 60 allows the flotation bladder 30 to rotate up to 20 degrees relative to horizontal to account for under-ice protrusions while maintaining buoy 12 in a horizontal position. Guide anchor 60 can take several forms as shown in FIGS. 3, 4 and 5. The embodiment of FIG. 3 will be described first.

In this embodiment, a separate guide anchor is provided for each riser 50 and 52, such that guide anchor 60 is a first eye bolt 62 and a second eye bolt 64 secured to mast housing 18 within buoy 12. Eye bolts 62 and 64 are of conventional construction. The aperture through first eye bolt 62 receives first riser 50 and maintains and guides first riser 5 within buoy housing 14. The aperture in second eye bolt 64 receives second riser 52. Bolts 62 and 64 allow risers 50 and 52 to freely move within the guide. This free movement maintains even tension along the length of risers 50 and 52 regardless of the position of flotation bladder 30. Therefore, as the position of flotation bladder 30 is varied, even tension is maintained along the length of risers 50 and 52. In this embodiment, eye bolt 62 is disposed on an opposite side of buoy housing 14 and preferably on mast housing 18 or other structure received within buoy housing 14 or on buoy housing 14 itself. This opposite positioning of eye bolt 62 and 64 maintains buoy 12 in a substantially vertical position despite the position of flotation bladder 30.

In a modified embodiment of the present invention, FIG. 4, a pair of eye bolts may be provided for each riser. This embodiment is similar to that shown in FIG. 3, however, an additional anchor for riser 50 is provided by including a pair of eye bolts 66' and 66'' rather than the individual eye bolts 62 as shown in FIG. 3. That is, riser 50 is guided within the buoy housing by a pair of eye bolts 66' and 66''. Although not shown, a second pair of such eye bolts would be provided on the opposite side of mast-housing 18 or other structure received within the buoy or on the interior of buoy housing 14 itself. This pair of eye bolts 66' and 66'' acts as a guide for anchoring riser 50 within the buoy. However, eye bolt 66' and 66'' allow riser 50 to freely move within the apertures of the eye bolt to maintain even tension along the risers as the position of the flotation bladder 30 is varied.

In the further modified embodiment of the invention, FIG. 5, the guide anchor is a hollow tube provided for each riser 50 and 52. First tube 70 is provided for guiding and anchoring riser 50 within buoy housing 14. A second tube 72 is provided within buoy housing 14 for anchoring riser 52. First tube 70 and second tube 72 are substantially identically shaped and include upturned ends 71 which open towards the bladder 30. First tube 70, as shown in FIG. 5, extends along the exterior of mast housing 18. Second tube 72 is disposed mid-way along the length of first tube 70, between first tube 70 and mast housing 18 and continues along the exterior of mast housing 18. Tubes 70 and 72 are secured to mast housing 18 by a pair of brackets 74' and 74''. A third bracket (not shown) similar to brackets 74' and 74'' maintains the second tube 72 against mast housing 18 with bracket 74''. Screws 75' and 75'' are provided for fastening brackets 74' and 74'' to mast housing 18. While screws have been described, any other similar fastener may be substituted. In the alternative, tubes 70 and 72 may be secured to the inner surface of buoy housing 14.

Each embodiment of the guide anchor may be made of any suitable material which is both strong, flexible and appropriate for use under water. Examples of suitable materials include stainless steel, copper, aluminum, and brass; brass being the preferred material.

In use, buoy 12 is deployed from a submarine or other underwater facility. An endcap (not shown) is affixed to the end of buoy housing 14 opposite base 16. Flotation bladder 30, risers 50 and 52 and penetrator 20 are disposed within buoy housing 14. Buoy 12 rises to the ocean surface underneath the ice (FIG. 2) where it floats vertical to the horizon. The endcap is expelled and the flotation bladder is inflated by means disposed within the buoy housing (not shown). Flotation bladder 30 extends from buoy housing 12 at a distance allowed by risers 50 and 52. Guide anchor 60, through which risers 50 and 52 extend, allows flotation bladder 30 to conform to the underside and often inclined undersurface of the ice. Guide anchor 60 maintains even tension on risers 50 and 52 as the position of flotation bladder 30 is varied. This provides a "gimballing" action which maintains buoy 12 (and its contents) in a substantially vertical position. Thus, if the flotation bladder is tilted, the risers slide within the tubes or eyebolts, thereby adjusting in length to accommodate the tilt of the flotation bladder 30. Thus, no unbalanced moments are transmitted to the buoy housing or to the mast housing 18 or ice penetrator 20. After the flotation bladder has been inflated and the buoy housing is at rest, ice penetrator 20 is extended from buoy housing 14 and penetrates through the ice to the surface. An antenna or other device may then be deployed.

Obviously, many modification and variations of the present invention may become apparent in light of the above teachings.

It is therefore understood that within the scope of the appended claims, the invention may be practiced otherwise than as specifically described.

What is claimed is:

1. A device for maintaining a buoy in a substantially vertical position comprising:

flotation means for causing said buoy to float, said flotation means disposed above said buoy and having first, second, third and fourth points, said first point and said second point being disposed opposite each other, and said third point and said fourth point behind disposed opposite each other;

a first riser having a first end and a second end, said first end attached to said flotation means at said first point and said second end attached to said flotation means at said second point;

a second riser having a first end and a second end, said first end of said second riser attached to said flotation means at said third point and said second end of said second riser attached to said flotation bladder at said fourth point; and means disposed on said buoy for guiding said first and second risers, said guiding means allowing said first and second risers to freely move within said guide to maintain even tension along said risers as the position of said flotation means is varied.

2. The device as set forth in claim 1, wherein said flotation means is inflatable bladder.

3. The device as set forth in claim 2, wherein said inflatable bladder is toroid-shaped having an inner perimeter and an outer perimeter.

4. The device of claim 3, wherein said inner perimeter is circular.

5. The device of claim 3, wherein said first, second, third and fourth points are disposed on said inner perimeter of said inflatable bladder.

6. The device of claim 1, wherein said first and second risers are formed of an aramid fiber.

7. The device of claim 1, wherein said guide means is disposed within said buoy.

8. The device of claim 7 wherein said guide means includes two.

9. The device of claim 8, wherein said two guide means are disposed at opposite sides of said buoy to each other.

10. The device of claim 9, wherein each of said two guide means is an eye bolt.

11. The device of claim 9, wherein each of said two guide means is a hollow tube.

12. The device of claim 1, wherein said first and second points form a first imaginary line and said third and fourth points form a second imaginary line, said second imaginary line being perpendicular to said first imaginary line.

* * * * *